US009163445B2

(12) United States Patent
Andren et al.

(10) Patent No.: US 9,163,445 B2
(45) Date of Patent: Oct. 20, 2015

(54) ALIGNMENT MECHANISM

(75) Inventors: Stefan B. Andren, Portland, OR (US); Nathaniel Shapiro, Portland, OR (US)

(73) Assignee: Stefan B. Andren, Portland, OR (US)

( * ) Notice: Subject to any disclaimer, the term of this patent is extended or adjusted under 35 U.S.C. 154(b) by 54 days.

(21) Appl. No.: 13/168,683

(22) Filed: Jun. 24, 2011

(65) Prior Publication Data

US 2011/0315846 A1 Dec. 29, 2011

Related U.S. Application Data

(60) Provisional application No. 61/358,393, filed on Jun. 24, 2010.

(51) Int. Cl.
*A47H 1/10* (2006.01)
*E05D 15/06* (2006.01)

(52) U.S. Cl.
CPC ..... *E05D 15/0634* (2013.01); *E05Y 2900/132* (2013.01); *E05Y 2900/148* (2013.01); *Y10T 29/49902* (2015.01)

(58) Field of Classification Search
USPC ..... 248/489, 495, 317, 323, 327; 16/105
See application file for complete search history.

(56) References Cited

U.S. PATENT DOCUMENTS

| | | | | | |
|---|---|---|---|---|---|
| 851,064 | A * | 4/1907 | Burkholder | 16/105 |
| 862,561 | A * | 8/1907 | Hunt | 16/105 |
| 1,609,390 | A * | 12/1926 | Viberg | 16/105 |
| 2,843,872 | A * | 7/1958 | Hannon | 16/105 |
| 3,142,859 | A * | 8/1964 | Suska | 16/105 |
| 3,182,350 | A * | 5/1965 | Witten | 16/105 |
| 3,555,612 | A * | 1/1971 | Procton | 16/105 |
| 4,288,887 | A * | 9/1981 | Johnson et al. | 16/105 |
| 4,391,019 | A * | 7/1983 | Downes | 16/105 |
| 4,478,006 | A * | 10/1984 | Johnson, Jr. | 49/410 |
| 5,070,575 | A * | 12/1991 | Redman et al. | 16/96 R |
| 6,698,138 | B1 * | 3/2004 | Lin | 49/409 |
| 6,865,848 | B2 * | 3/2005 | Krimmel | 49/409 |
| 7,637,059 | B2 * | 12/2009 | Chang et al. | 49/425 |
| 7,762,517 | B1 * | 7/2010 | Leseman | 248/489 |
| 7,797,853 | B2 * | 9/2010 | Compton | 33/613 |
| 2001/0011583 | A1 * | 8/2001 | Spork | 160/199 |
| 2005/0072890 | A1 * | 4/2005 | Elmer | 248/317 |
| 2008/0134554 | A1 * | 6/2008 | Pitcher et al. | 40/606.14 |
| 2009/0127412 | A1 * | 5/2009 | Kleege | 248/214 |

* cited by examiner

*Primary Examiner* — Bradley Duckworth
(74) *Attorney, Agent, or Firm* — Marger Johnson

(57) ABSTRACT

The present disclosure relates to an adjustment mechanism for aligning a hanging structure, such as a door panel, window, art work, ladder, curtain, or decorative element.

17 Claims, 6 Drawing Sheets

ALIGNMENT MECHANISM

CROSS-REFERENCE TO RELATED APPLICATION

This application claims priority to U.S. Provisional Patent Application Ser. No. 61/358,393 that was filed on Jun. 24, 2010, entitled, "Adjustment Mechanism," the contents of which are hereby incorporated by reference in their entirety.

FIELD

The present disclosure relates to alignment mechanisms for hanging structures.

BACKGROUND

Hanging objects have become a common part of contemporary architecture and design. Many consumers are interested in hanging door panels, windows, curtains, art work, ladders, and the like, within a room. Aligning these hanging structures can be challenging and minor adjustments are often needed. In some arrangements, these hanging structures need to be aligned with respect to the wall or another structure within the room. In other arrangements, one hanging object needs to be aligned with respect to another hanging object (and perhaps the wall or another structure within the room). These hanging structures are often secured to a wall or another structure at or near the ceiling of a room, which leaves little space within which to adjust the hanging structures so they can be aligned. Many of the known hardware is bulky and difficult to adjust within such a small space, and often times even requires the mounting holes in the hanging object to be re-drilled several times until alignment is perfected.

SUMMARY

The present invention overcomes these and other problems with known hanging structure adjustment mechanisms. It offers an elegant, sleek adjustment mechanism that is easily accessed and adjusted without compromising durability and strength.

In some disclosed embodiments, an adjustable hanging structure includes a hanging structure; a first adjustment mechanism operably secured to the hanging structure at a first attachment position and a second adjustment mechanism operably secured to the hanging structure at a second attachment position. The first adjustment mechanism may be adjustable in one or more directions with a first screw and the second adjustment mechanism may be adjustable in one or more directions with a second screw. When the first adjustment mechanism and the second adjustment mechanism are adjusted, the hanging structure is moved in one or more directions. The first adjustment mechanism and the second adjustment mechanism may be operably secured to a respective first roller assembly and a second roller assembly that roll a hanging structure along a base surface.

In another aspect, a hanging structure is aligned by loosely operably securing a first roller assembly having a first adjustment mechanism to a hanging structure at a first position with a first mounting structure. A second roller assembly having a second adjustment mechanism is loosely operably secured to the hanging structure at a second position that is spaced apart from the first position with a second mounting structure. At least one of the first adjustment mechanism and the second adjustment mechanism are adjusted such that the hanging structure is aligned with respect to an axis. Then the first roller assembly is tightly operably secured to the hanging structure by tightening the first mounting structure and the second roller assembly is tightly operably secured to the hanging structure by tightening the second mounting structure. In this method, a majority of the weight of the hanging structure is distributed by at least one of the first mounting structure and the second mounting structure when the first mounting structure and the second mounting structure are tightly operably secured to the hanging structure thereby preventing the adjustment structure from bearing substantial weight of the hanging structure during normal day-to-day operation.

DRAWINGS

The drawings described herein are for illustrative purposes only of selected embodiments and not all possible implementations, and are not intended to limit the scope of the present disclosure.

DETAILED DESCRIPTION

FIGS. 1-5B illustrate a first preferred embodiment of an exemplar adjustment mechanism 100 for a hanging structure 102 that is preferably operably secured to a roller assembly 104 that rolls the hanging structure 102 along a base surface 108. FIG. 6 illustrates an alternative preferred adjustment mechanism 100' for the roller assembly 104 with like elements between the embodiments being like numbered so as to reduce repetition. An exemplary roller assembly 104 is described in U.S. patent application Ser. No. 12/815,254, filed on Jun. 14, 2010 and entitled, "Roller Assembly," the contents of which are incorporated herein by reference.

Figure 3A:
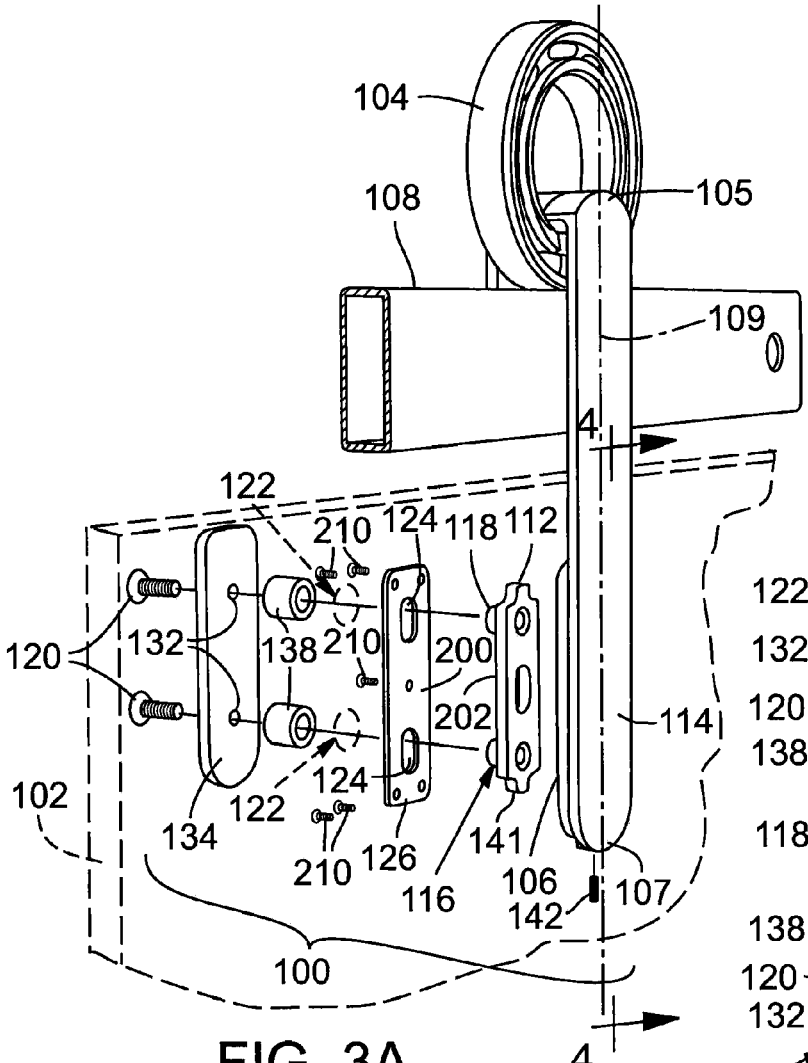
FIGS. 3A & 3B illustrate exploded front and rear views, respectively, of the roller assembly with adjustment mechanism of FIG. 2.
Figure 4:
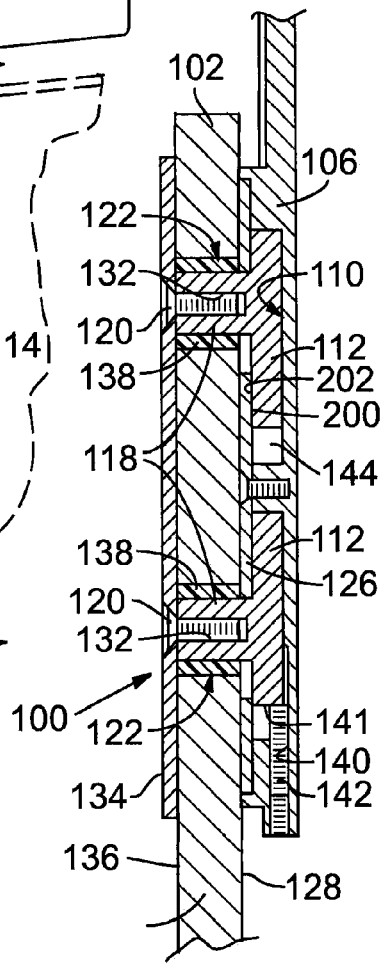
FIG. 4 is an enlarged, assembled, cross-sectional view of the adjustment mechanism portion of the roller assembly of FIG. 2, taken along plane 4-4 of FIG. 3A.
Figure 3B:
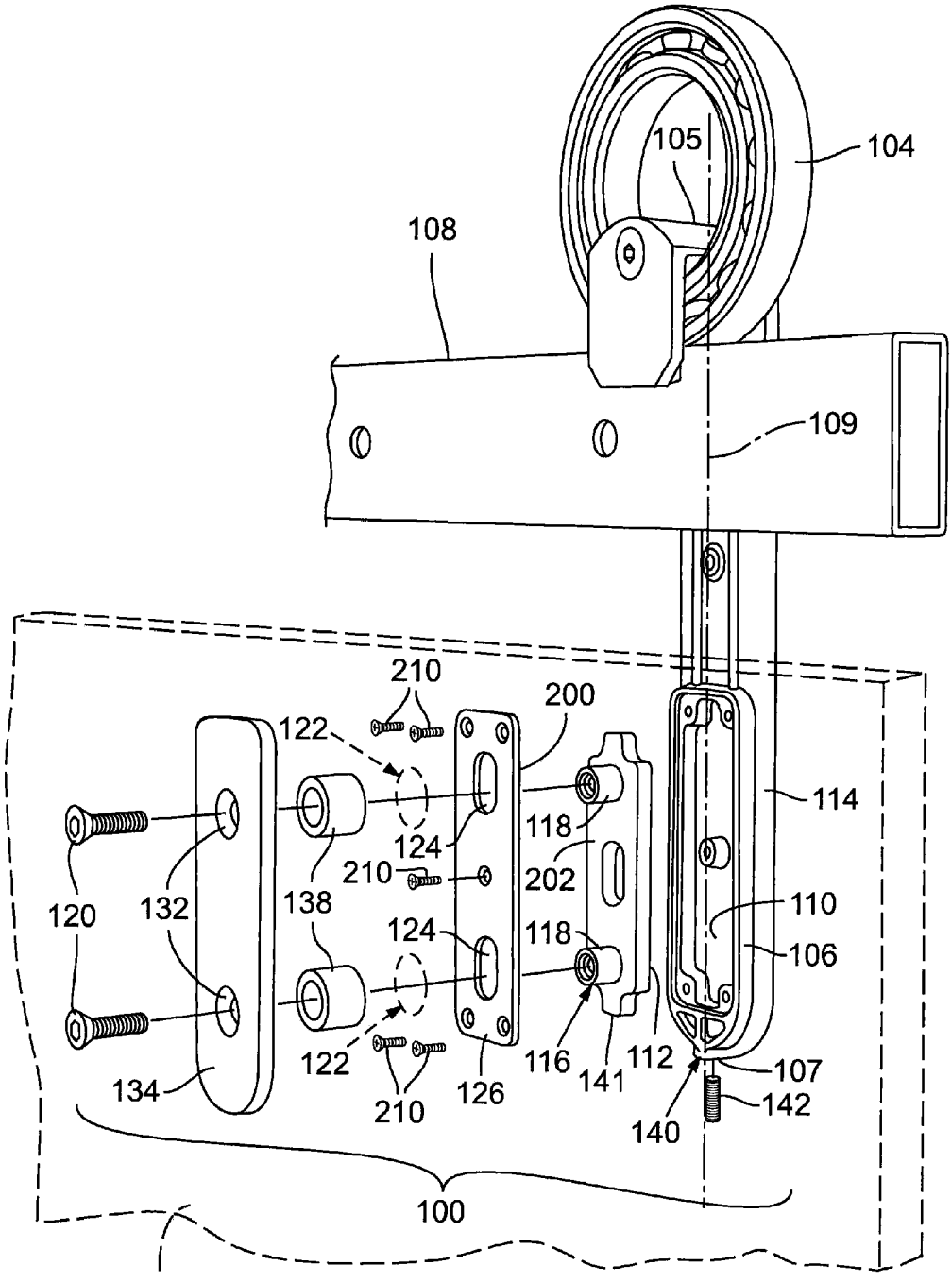
Figure 5A:
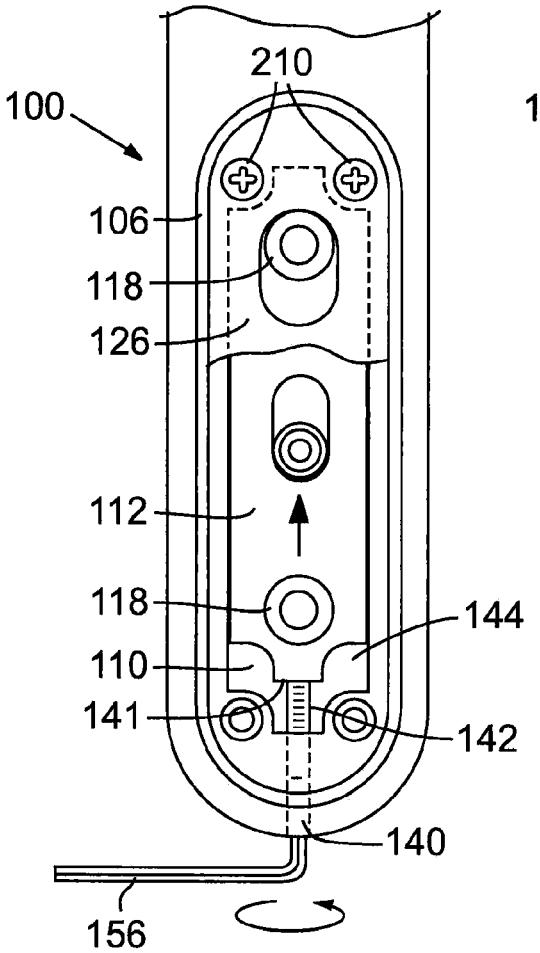
FIGS. 5A and 5B are enlarged fragmentary views of the adjustment mechanism portion of the roller assembly of FIG. 2, showing a possible a first position and a second position of the infinitely adjustable adjustment mechanism, respectively.
Figure 5B:
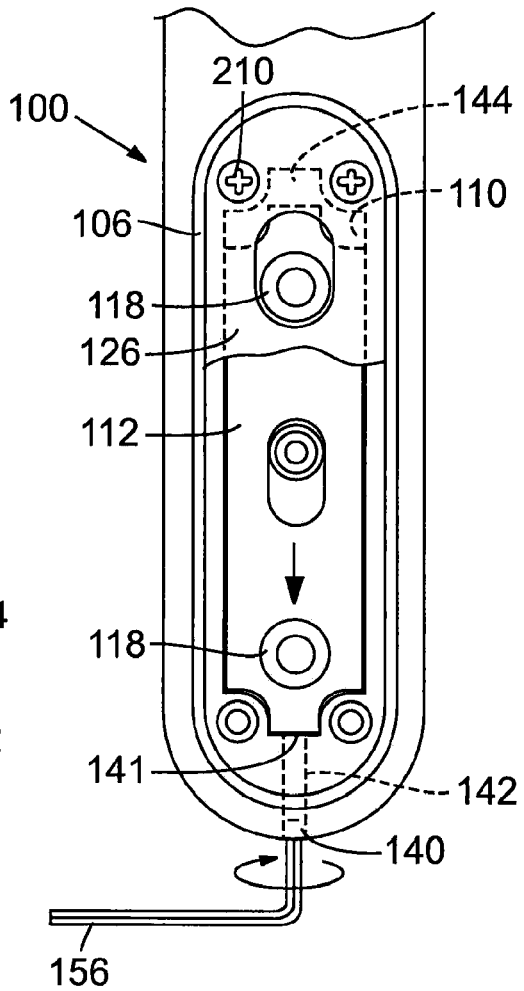
Figure 6:
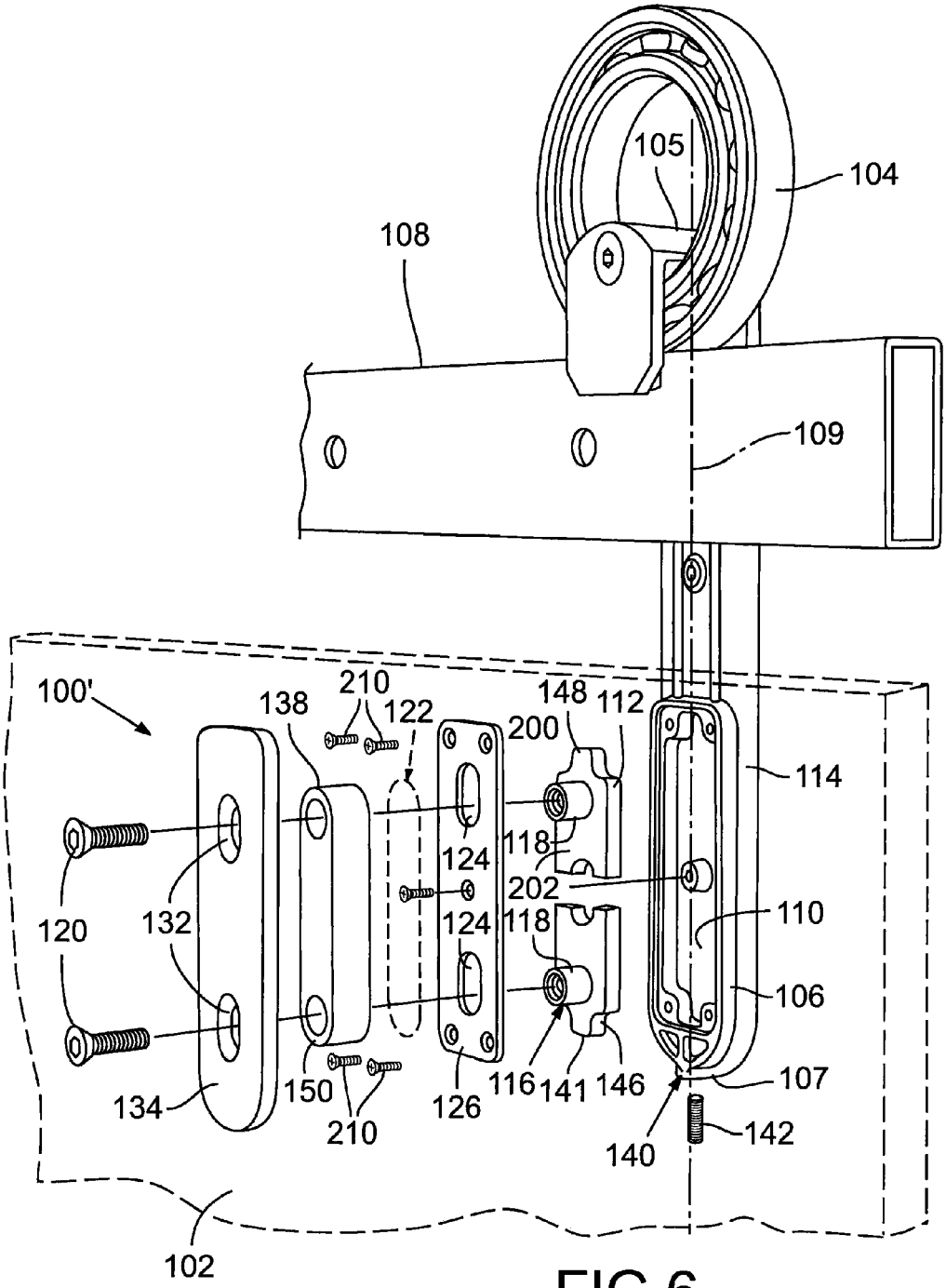
FIG. 6 illustrates a rear, exploded view of a roller assembly having an alternative possible adjustment mechanism embodiment in accordance with aspects of the disclosure.

As best shown in FIGS. 3B, 5A & 5B, the adjustment mechanism 100 preferably includes an elongate frame 106 having an upper end 105 and an opposite lower end 107 and defining an elongate channel or recess 110 preferably toward the lower end 107. The recess 110 is aligned along the longitudinal length 109 of the frame 106. An elongate plate 112 shaped to fit within and slide along the recess 110 is operably received within the recess 110 and covered with faceplate 124 thereby allowing the plate 112 to slide within the recess 110 up and down the longitudinal length 109 of the frame as shown in FIGS. 5A and 5B. The plate 112 is secured to the hanging structure 102, preferably with mounting screws 120 (FIGS. 3A, 3B & 4) or the like that extend through openings 122 (FIGS. 3A, 3B, 4) in the hanging structure 102 and into the plate 112. The adjustment mechanism 100 operably positions the plate 112 within the recess 110 thereby allowing the position of the hanging structure 102 to be infinitely adjustable relative to the frame 106.

Preferred structures for operably securing the plate 122 to the hanging structure 102 are best shown in FIGS. 3A, 3B and 4. For example, the adjustable plate 112 preferably includes a mounting structure 116 that has two screw receptacles. Any suitable number of screw receptacles 118 may be included in alternative examples. Mounting screws 120 are inserted into corresponding screw receptacles 118 for mounting the hanging structure 102 to the frame 106 and operably engaging the adjustment mechanism 100. The hanging structure 102 includes two holes 122 through which the screw receptacles 118 (or any portion of the mounting structure 116) are inserted. The screw receptacles 118 are inserted through corresponding holes 124 in a first face plate 126 positioned on a first surface 128 of the hanging structure 102. Mounting screws 120 are inserted through holes 132 of a second face plate 134 positioned on a second, opposing surface 136 of the hanging structure 102. The screw receptacles 118 are inserted through a pair of bushings 138 that space apart the first face plate 126 from the second face plate 134 to accommodate approximately the width of the hanging structure 102. In alternative embodiments, second face plate 134 includes separate washers. For example, a first washer and a second washer are replaced with the second face plate 134 that is illustrated in FIGS. 3A, 3B, and 4. In this example, screws 120 would be inserted through the first washer and the second washer, respectively.

The faceplate 126 is secured over the recess 110 containing the elongate plate 112 with low profile screws 210 or the like as shown in FIGS. 3B and 5A such that surface 202 on the elongate plate 112 slides along surface 200 (FIGS. 3A & 4) on the faceplate 126 when the mounting screws 120 are not tightly secured to the screw receptacles 118 in the elongate plate 112. It can be appreciated that tightening the screws 120 into the screw receptacles 118 with urge surface 202 toward surface 200 thereby providing a friction mount between these surfaces and preventing the plate 112 from sliding within the recess 110.

If desired, additional friction materials and/or roughening of one or both of the surfaces 202, 200 and between the faceplates 126, 134 and the hanging structure 102 can be added to further facilitate this friction mount when the mounting screws 120 are fully secured to the screw receptacles 118. In addition, protective elements that are positioned between the first face plate 126 and the hanging structure 102 and/or the second face plate 134 and the hanging structure 102. For example, the hanging structure 102 is a glass panel. The elements of the adjustment mechanisms 100 include some type of rigid material(s), such as one or more metals, in this example. The protective element is positioned between the rigid elements of the adjustment mechanisms 100 and the glass panel to protect the glass panel from wear and/or damage by contacting the metal elements of the adjustment mechanism 100. The protective elements are any suitable structure and may include any suitable material(s) such as rubber. The protective elements are any suitable shape and size. In the examples illustrated in FIGS. 1-5B, the protective elements include the rubber bushings 138. Additional protective elements that are not illustrated in the Figures include a layer of protective material, such as foam, rubber, plastic or the like that is positioned between the hanging structure 102 and any one or more portions of the adjustment mechanism 100.

A preferred exemplary adjustment mechanism 110 is best shown in FIGS. 3A, 3B, 4, 5A and 5B. The frame 106 of this adjustment mechanism 100 includes a tunnel 140 into which an adjustment screw 142, is positioned such that the adjustment screw 142 comes into contact with a first end 141 of the adjustable plate 112. When the adjustment screw 142 is adjusted, the adjustable plate 112 is moved from a first position to a second position, as illustrated in FIGS. 4A and 4B, respectively. In the example illustrated in FIGS. 5A and 5B, the recess 110 includes a clearance space 144 and the adjustable plate 112 is moved in the direction of the clearance space 144. Any suitable number of clearance spaces may be included in other examples and the clearance spaces may be positioned in any suitable location within the recess.

The adjustable plate 112 is moved along a vertical axis in the example illustrated in FIGS. 1-5B. In other examples, the adjustable plate 112 is moved in any suitable direction, including in an arc, based on the shape of the adjustable plate 112 and the manner in which the adjustable plate 112 contacts the adjustment screw 142.

The tunnel 140 is positioned in any suitable location on the adjustment mechanism 100. In the examples illustrated in FIGS. 1-5B, the adjustment mechanism 100 has an upper end 144 and an opposing, the lower end 146. The tunnel 140 is positioned on a lower end 146 of the adjustment mechanism 100, farthest away from the base surface along which the hanging structure 102 rolls. This positioning of the tunnel 140 permits the adjustment screw 142 positioned within the tunnel 140 to be adjusted from the bottom of the adjustment mechanism 100, which is not obstructed by the roller assembly 104, the base surface 108 or the ceiling or other structure to which the base surface 108 is mounted.

In another embodiment of the adjustment mechanism 100 illustrated in FIG. 6, the adjustable plate 112 includes a first portion 146 and a second portion 148 that are discrete structures from each other. In the embodiments illustrated in FIGS. 1-5B, the adjustable plate 112 includes a first portion and a second portion that are integrally formed with each other. Referring again to FIG. 6, the two bushings 138 include an interconnecting member 150. The interconnecting member 150 causes the bushings 138 to function as a single unit, which provides stability to the discrete portions of the adjustable plate 112 in this embodiment. The interconnecting member 150 is any suitable shape, size, and thickness. In another embodiment, the two bushings 138 are two discrete elements, as illustrated in the example shown in FIGS. 3A and 3B. The holes 132 of the face plate 134 are oblong to accommodate any adjustments in the spacing between the two screw receptacles 118 that are needed when the adjustable plate 112 is inserted through the holes 122 in the hanging structure 102. This adjustability feature accommodates a variance in the spacing between the hole or holes 122 in the hanging structure 102. In the example illustrated in FIG. 6, the hole 122 in the hanging structure 102 in a single hole. However, in alternative examples, the hanging structure 102 includes more than one hole 122, as illustrated in FIGS. 3A and 3B.

The remaining elements of the adjustment mechanism function in the same manner in this embodiment as in the embodiment illustrated in FIGS. 1-5B. The embodiment illustrated in FIG. 6 permits the two screw receptacles 118 of the mounting structure 116 to be adjusted to accommodate a variance in the distance between the holes 122 in the hanging structure 102. In an alternative embodiment, any suitable number of discrete portions of the adjustable plate 112 may be included.

An adjustment tool 156, such as the Allen wrench illustrated in FIGS. 4A and 4B, adjusts the positioning of the adjustment screw 142 within the tunnel 140 to move the adjustment screw 142 in the desired direction. As illustrated in FIGS. 4A and 4B, the Allen wrench 156 causes the adjustment screw 142 to move vertically within the tunnel 140, which causes the adjustable plate 112 to move in any suitable direction, including vertically, horizontally, and at any angle (or arc) with respect to the hanging structure 102.

In another aspect, a hanging structure is aligned by loosely operably securing a first roller assembly having a first adjustment mechanism to a hanging structure at a first position with a first mounting structure, then loosely operably securing a second roller assembly having a second adjustment mechanism to a hanging structure at a second position with a second mounting structure. The mounting structures, roller assemblies, and hanging structures are described above. Then at least one of the first adjustment mechanism and the second adjustment mechanism are adjusted such that the hanging structure is aligned with respect to an axis (e.g., a vertical axis, as illustrated in FIGS. 1-5B, but may be any other desirable axis). The first adjustment mechanism and the second adjustment mechanism may be adjustable by adjusting any adjustment screw 142 in the examples described above.

Once the hanging structure is aligned in the desired manner, the first roller assembly is tightly operably secured to the first roller assembly by tightening the first mounting structure and the second roller assembly is tightly operably secured to the second roller assembly by tightening the second mounting structure. The steps of tightening the first mounting structure and the second mounting structure include securing the mounting screw 120 within the screw receptacles 118, as described in the examples above. Once the first mounting structure and the second mounting structure are tightly operably secured to the hanging structure, the majority of the weight of the hanging structure is distributed by at least one of the first mounting structure and the second mounting structure. In this example, little, if any, weight of the hanging structure 102 is sustained by the adjustment screw 142.

For example, one or more of the adjustment mechanisms 100 illustrated in FIGS. 1-5B is loosely operably secured to the hanging structure 102. The adjustment screw 142 is adjusted so that the adjustable plate 112 moves and aligns the hanging structure 102 in the desired position. Then the adjustment mechanism 100 is tightly operably secured to the hanging structure 102 by tightly securing the mounting screws 120 within the screw receptacles 118. As best shown in FIGS. 3A, 3B and 4, this causes the friction mount between surfaces 200 on faceplate 126 and surface 202 on elongate plate 112 and it also urges the second face plate 134 toward face plate 126 thereby compressing these plates against the hanging structure 102. As a result, the load of the hanging structure 102 is evenly distributed to the frame 100 without placing undue pressure on the holes 122 in the hanging structure 102. Moreover, this compression mount relieves the temporary load borne by the adjustment screw 142 during the adjustment process thereby allowing considerably less bulky materials, such the use of a more aesthetically pleasing, but smaller, less load bearing, adjustment screw 142 to be used for some components of the adjustment mechanism 110

Having here described preferred embodiments of the present invention, it is anticipated that other modifications may be made thereto within the scope of the invention by individuals skilled in the art. For example, optional features may be added to any aspects of the adjustment mechanisms described above. Also, the shape and contour of any one or more elements of the adjustment mechanism may vary in any suitable manner. Similarly, individual elements or features of a particular aspect of the adjustment mechanism are generally not limited to that particular aspect, but, where applicable, are interchangeable and can be used in a selected aspect, even if not specifically shown or described. The same also may be varied in many ways.

Figure 1:
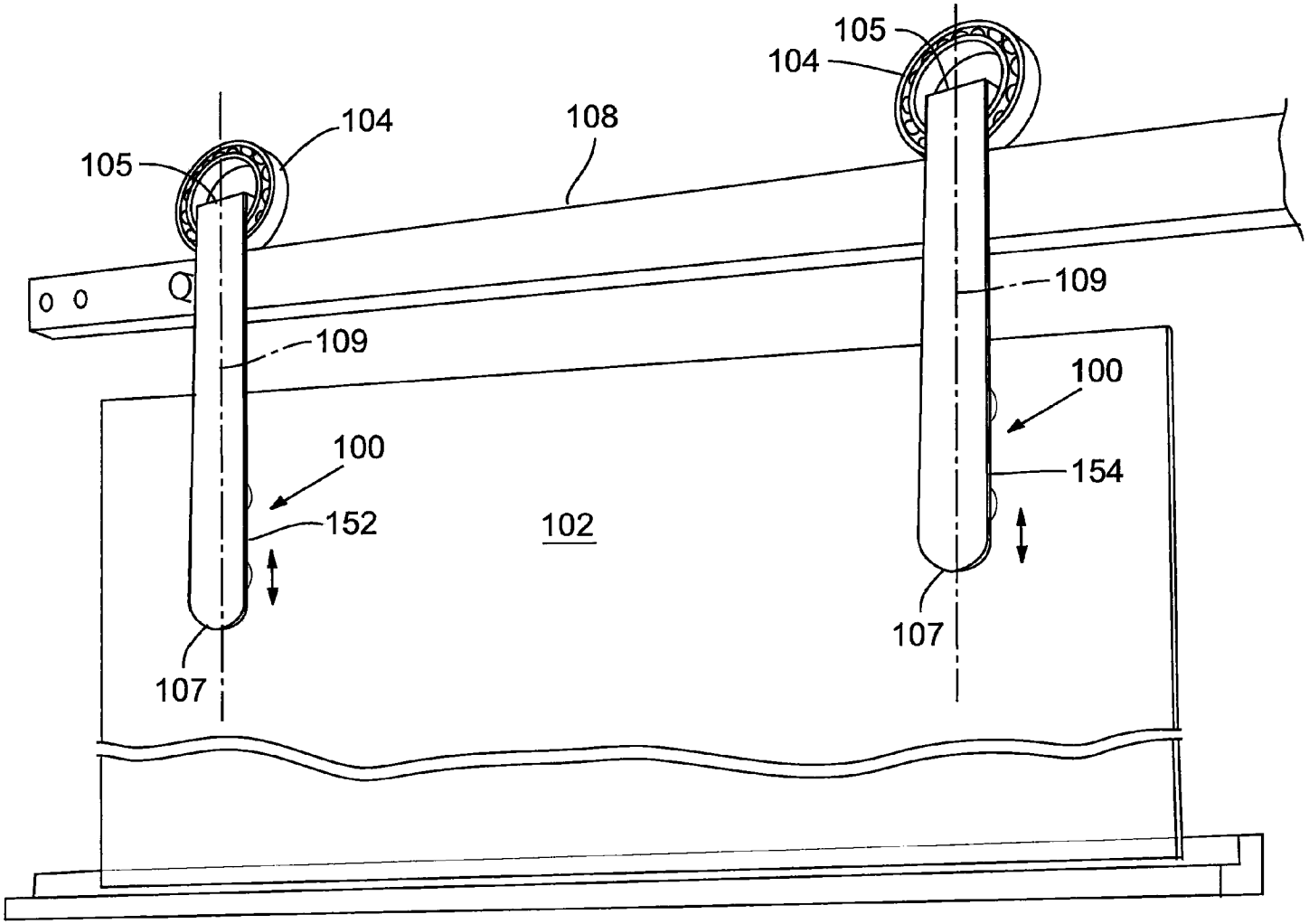
FIG. 1 is an isometric view of two exemplary adjustable roller assemblies with adjustment mechanisms in accordance with a first embodiment of the present invention. The roller assemblies are shown operably secured to a hanging structure to show possible orientation of the roller structures relative to the hanging structure, according to aspects of the disclosure.
Figure 2:
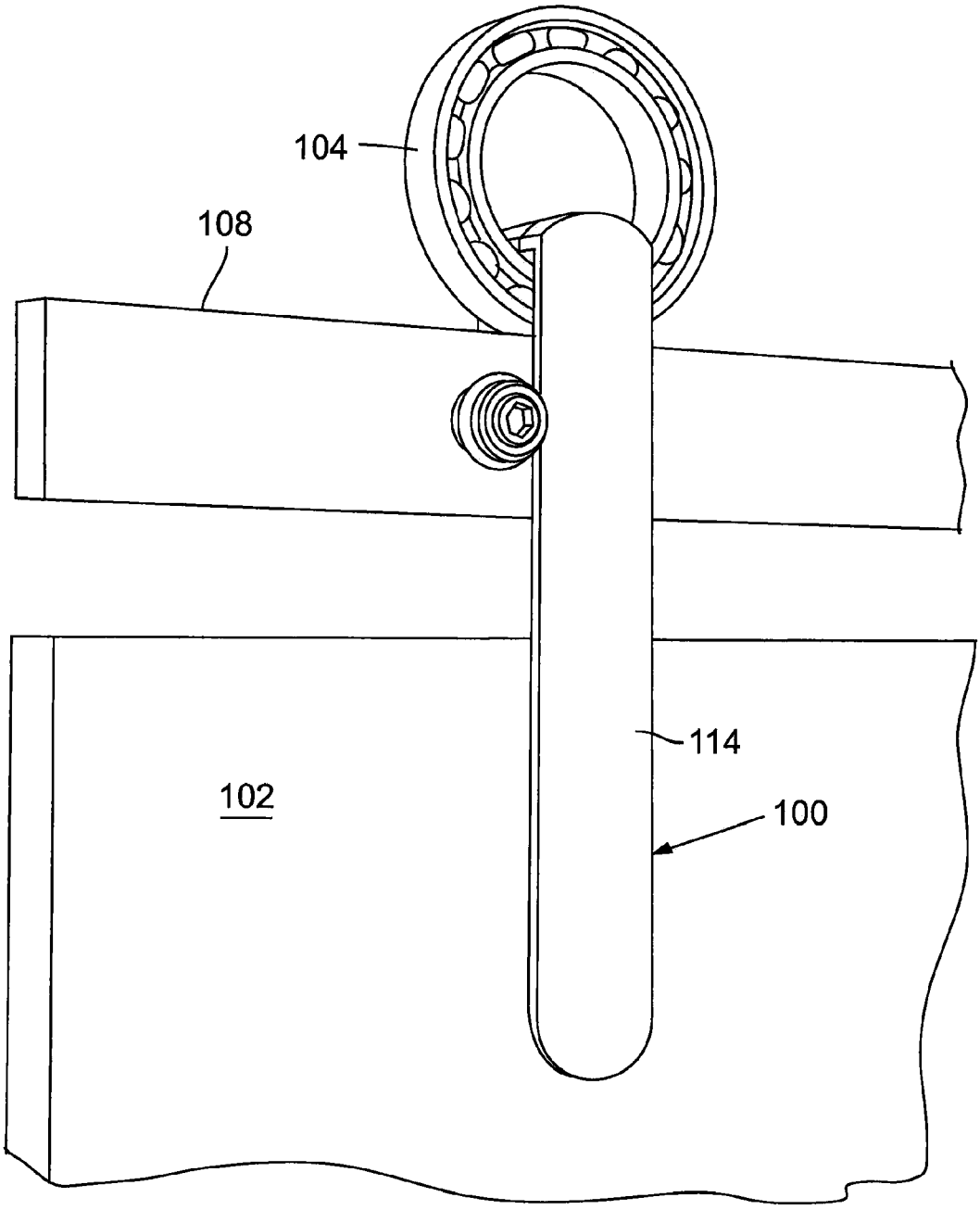
FIG. 2 illustrates an enlarged, isometric view of a roller assembly with an adjustment mechanism of FIG. 1.

Also, one or more adjustment mechanisms 100 may be operably secured to corresponding roller assemblies 104. For example, FIG. 1 illustrates two adjustment mechanisms 100 that are operably secured to two respective roller assemblies 104. The roller assemblies 104 roll the hanging structure 102 along a base surface 108. In FIG. 1, a first adjustment mechanism 100 is operably secured to the hanging structure 102 at a first attachment position 152 and the second adjustment mechanism 100 is operably secured to the hanging structure 102 at a second attachment position 154 that is spaced apart from the first attachment position 152. Because the first attachment position 152 and the second attachment position 154 are spaced apart from each other, the hanging structure 102 is movable in more than one direction. For example, each adjustment mechanism is movable along a vertical axis, which rotates the hanging structure 102 in the desired direction(s).

In addition, while the adjustment mechanism 100 is preferably positioned near a mounting portion 114 of the frame 106, in other aspects or applications it may be desirable to position the adjustment mechanism 100 and/or the frame 106 at any other position. Also, in the disclosed embodiment, the recess 110 is approximately positioned in a center region of the frame 106. In other possible examples, the recess 110 is positioned in any suitable position on the frame 106 so long as the recess 110 is any suitable size and shape to operably receive a slidable plate 112. While the example roller assemblies 104 illustrated in FIGS. 1-6 include one adjustment mechanism 100, any desired number of adjustment mechanisms may be included in alternative examples. The roller assemblies 104 can be integrally formed with their respective adjustment mechanisms 100 in the example illustrated in FIGS. 1-6 or the roller assemblies 104 are discrete structures from the adjustment mechanisms 100. Similarly, the hanging structure 102 may be any suitable structure including, but not limited to a door panel, a window panel, window coverings, curtains, ladders, art work, decorative elements, or the like.

Thus, although preferred, more preferred, and alternative embodiments of the present invention have been described, it will be appreciated that the spirit and scope of the invention is not limited to those embodiments, but extend to the various modifications and equivalents as defined in the appended claims.

We claim:

1. An adjustable hanging structure, comprising:

a hanging member having a weight;

a threaded adjustment mechanism operably secured to the hanging member at an attachment position, the adjustment mechanism being configured to adjust in at least one direction; and a friction mount operably secured to the adjustment mechanism, the friction mount including a first plate detachably secured to the hanging member and a second plate secured to the adjustment mechanism, a face of the first plate substantially contacting a face of the second plate in an engaged position, the face of the second plate being substantially between the face of the first plate and the hanging member, the friction mount being configured to reduce the amount of the weight of the hanging member borne by a screw of the threaded adjustment mechanism in the engaged position.

2. The adjustable hanging structure of claim 1, wherein the hanging member is at least one of a panel, a door, a window, a curtain, a ladder, and a piece of artwork.

3. The adjustable hanging structure of claim 1, wherein the adjustment mechanism comprises a frame defining a recess, wherein the first plate is shaped to fit within the recess, and wherein the first plate moves from a first position to a second position within the recess when the adjustment mechanism is adjusted.

4. The adjustable hanging structure of claim 3, wherein the first plate includes a first portion and a second portion that are integrally formed with each other.

5. The adjustable hanging structure of claim 3, wherein the first plate includes a first portion and a second portion that is discrete from the first portion.

6. The adjustable hanging structure of claim 3, wherein the frame includes a tunnel into which the screw is positioned such that the screw comes into contact with a first end of the first plate such that when the screw is adjusted, the first plate is moved from the first position to the second position in the at least one direction.

7. The adjustable hanging structure of claim 6, wherein the frame is an elongate structure defining an upper end and an opposite lower end and the tunnel is positioned toward the lower end of the frame.

8. An adjustable roller assembly, comprising:

a roller assembly for rolling a hanging member along a base surface; and an adjustable hanging structure as recited in claim 1;

wherein the adjustment mechanism is operably secured to the roller assembly.

9. The adjustable roller assembly of claim 8, wherein the hanging member is at least one of a panel, a door, a window, a curtain, a ladder, and a piece of artwork.

10. The adjustable roller assembly of claim 9, wherein the adjustment mechanism has an upper end and an opposing, lower end and a tunnel configured to receive the screw is positioned on the lower end of the adjustment mechanism.

11. The adjustable roller assembly of claim 10, wherein the adjustment mechanism is integrally formed with the roller assembly.

12. A method of aligning a hanging structure having a weight, comprising:

loosely operably securing a first roller assembly having a first adjustment mechanism to the hanging structure at a first position with a first mounting structure;

loosely operably securing a second roller assembly having a second adjustment mechanism to the hanging structure at a second position that is spaced apart from the first position with a second mounting structure;

adjusting the first adjustment mechanism, such that the hanging structure is aligned to an axis; and, operably securing the first roller assembly to the hanging structure by tightening a first friction mount, the first friction mount comprising a first plate detachably secured to the hanging structure and a second plate secured to the first adjustment mechanism, a face of the first plate substantially contacting a face of the second plate in an engaged position of the first friction mount, the face of the second plate being substantially between the face of the first plate and the hanging structure, the first friction mount in the engaged position preventing further adjusting of the first adjustment mechanism;

operably securing the second roller assembly to the hanging structure by tightening a second friction mount, the second friction mount comprising a third plate detachably secured to the hanging structure and a fourth plate secured to the second adjustment mechanism, a face of the third plate substantially contacting a face of the fourth plate in an engaged position of the second friction mount, the face of the fourth plate being substantially between the face of the third plate and the hanging structure, the engaged position of the second friction mount preventing adjustment of the second adjustment mechanism;

wherein a majority of the weight of the hanging structure is distributed away from the first adjustment mechanism and the second adjustment mechanism by the first friction mount and the second friction mount, respectively, when the first friction mount is in the engaged position and second friction mount is in the engaged position.

13. The method of aligning a hanging structure of claim 12, wherein the first mounting structure is adjusted by accessing a first screw positioned at a bottom of the first adjustment mechanism.

14. An adjustable mount for operably securing a hanging structure having a weight to a base comprising:

an elongate frame having a base engaging portion and a hanging structure engaging portion;

a plate secured to the hanging structure and slidably secured to the frame;

an adjustment member extending from the frame to the plate so as to regulate the position of the plate relative to the frame;

a friction mount operably secured between the hanging structure and the hanging structure engaging portion to distribute the weight of the hanging structure away from the adjustment member, wherein the plate is slidably received within a recess on the elongate frame, and further including a faceplate enclosing the plate within the recess, and further including a mounting structure operably extending from the plate and through the faceplate and hanging structure, the mounting structure configured to compress the faceplate between the plate and hanging structure to form the friction mount.

15. The adjustable mount of claim 14, wherein the friction mount has an engaged position and a disengaged position and is secured between the hanging structure and frame so as to hold the plate in place relative to the frame when the friction mount is in its engaged position.

16. The adjustable mount of claim 14, wherein the frame has a top end and a bottom end and the adjustment member extends towards the bottom end.

17. The adjustable mount of claim 14, wherein the mounting structure is a threaded fastener.

* * * * *